US007438570B2

(12) United States Patent
Mori et al.

(10) Patent No.: US 7,438,570 B2
(45) Date of Patent: Oct. 21, 2008

(54) LEVER FITTING-TYPE CONNECTOR

(75) Inventors: Shigeo Mori, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/604,261

(22) Filed: Nov. 27, 2006

(65) Prior Publication Data

US 2007/0134957 A1 Jun. 14, 2007

(30) Foreign Application Priority Data

Nov. 25, 2005 (JP) ..... P2005-340046

(51) Int. Cl.
*H01R 13/62* (2006.01)

(52) U.S. Cl. ..... 439/157; 439/924.1

(58) Field of Classification Search ..... 439/372, 439/157, 924.1, 489

See application file for complete search history.

(56) References Cited

U.S. PATENT DOCUMENTS 5,913,691 A * 6/1999 Clark et al. ..... 439/157
6,325,648 B1 * 12/2001 Bilezikjian et al. ..... 439/157
6,685,496 B2 * 2/2004 Ookura ..... 439/372
6,899,554 B1 * 5/2005 Osada ..... 439/157
6,971,894 B2 * 12/2005 Dillon et al. ..... 439/157
7,044,758 B2 * 5/2006 Deno et al. ..... 439/157
7,137,835 B2 * 11/2006 Shiga ..... 439/157
2005/0245114 A1 * 11/2005 Shiga ..... 439/157

FOREIGN PATENT DOCUMENTS

JP 2002-343506 A 11/2002
JP 2005-294038 A 10/2005

* cited by examiner

*Primary Examiner*—Neil Abrams
*Assistant Examiner*—Phuong Nguyen
(74) *Attorney, Agent, or Firm*—Sughrue Mion, PLLC

(57) ABSTRACT

An interlocking male terminal 45 is contained in a slider 4, and an interlocking female terminal 35 is contained in a male connector 3 so as to be opposed to the interlocking male terminal 45. When fitting a female connector 2 and the male connector 3 together, a connecting lever 23 is pivotally moved through an angle of about 90 degrees in a direction of arrow M, and then the slider 4 is advanced in a direction of arrow A. As a result, the female and male connectors 2 and 3 are completely fitted together, and also the interlocking male terminal 45 is connected to the interlocking female terminal 35, so that wires 5 are electrically connected respectively to wires 6. The interlocking female terminal 45 is formed integrally with the slider 4, and the interlocking female terminal 35 is formed integrally with the male connector 3, and therefore a lever fitting-type connector 1 can be reduced in size or length, and besides the number of the component parts thereof can be reduced.

6 Claims, 7 Drawing Sheets

LEVER FITTING-TYPE CONNECTOR

BACKGROUND OF THE INVENTION

1. Field of the Invention

This invention relates to a lever fitting-type connector used for electrically connecting, for example, a motor and an inverter of an automobile together.

2. Description of the Related Art

In lever fitting-type connectors of this kind, there has heretofore been proposed a method (hereinafter referred to as "known technique 1") of mechanically detecting the fitting of female and male connectors (see, for example, JP-A-2005-294038 Publication (Paragraphs [0002] and [0003])).

In order to prevent arc discharge from occurring at the time of disconnecting two connectors from each other, there has also been proposed a method (hereinafter referred to as "known technique 2") of electrically detecting the fitting of the connectors (see, for example, JP-A-2002-343506 Publication (Paragraph [0007])).

However, when the two known techniques 1 and 2 are merely combined together in order to obtain advantages of the two techniques at the same time, there have been encountered problems that the lever fitting-type connector increases in size or length and that the number of the component parts increases.

It is an object of this invention to provide a lever fitting-type connector which can solve the above problems

[Means for Solving the Problem]

According to the invention of claim 1, there is provided a lever fitting-type connector comprising a fitting mechanism in which by operating a connecting lever, a pair of connectors are drawn toward each other to be retained relative to each other, and in this condition a slider is slid to be engaged with the connecting lever to lock the connecting lever; and a signal circuit for establishing and breaking electrical connection between wires connected to the respective connectors; characterized in that the slider contains an interlocking terminal for closing the signal circuit in a locked condition of the connecting lever and for opening the signal circuit in an unlocked condition of the connecting lever.

The lever fitting-type connector of the invention of claim 2 is characterized in that there is provided an inoperative-side lock mechanism for locking the slider disposed in an inoperative position.

The lever fitting-type connector of the invention of claim 3 is characterized in that there is provided an inoperative-side lock cancellation mechanism for canceling a locked condition of the slider disposed in the inoperative position.

The lever fitting-type connector of the invention of claim 4 is characterized in that there is provided an operative-side lock mechanism for locking the slider disposed in an operative position.

In the present invention, the interlocking terminal is formed integrally with the slider, and therefore the lever fitting-type connector can be reduced in size or length, and besides the number of the component parts of the lever fitting-type connector can be reduced.

DESCRIPTION OF THE PREFERRED EMBODIMENTS

A preferred embodiment of the present invention will now be described with reference to the drawings.

Figure 1:
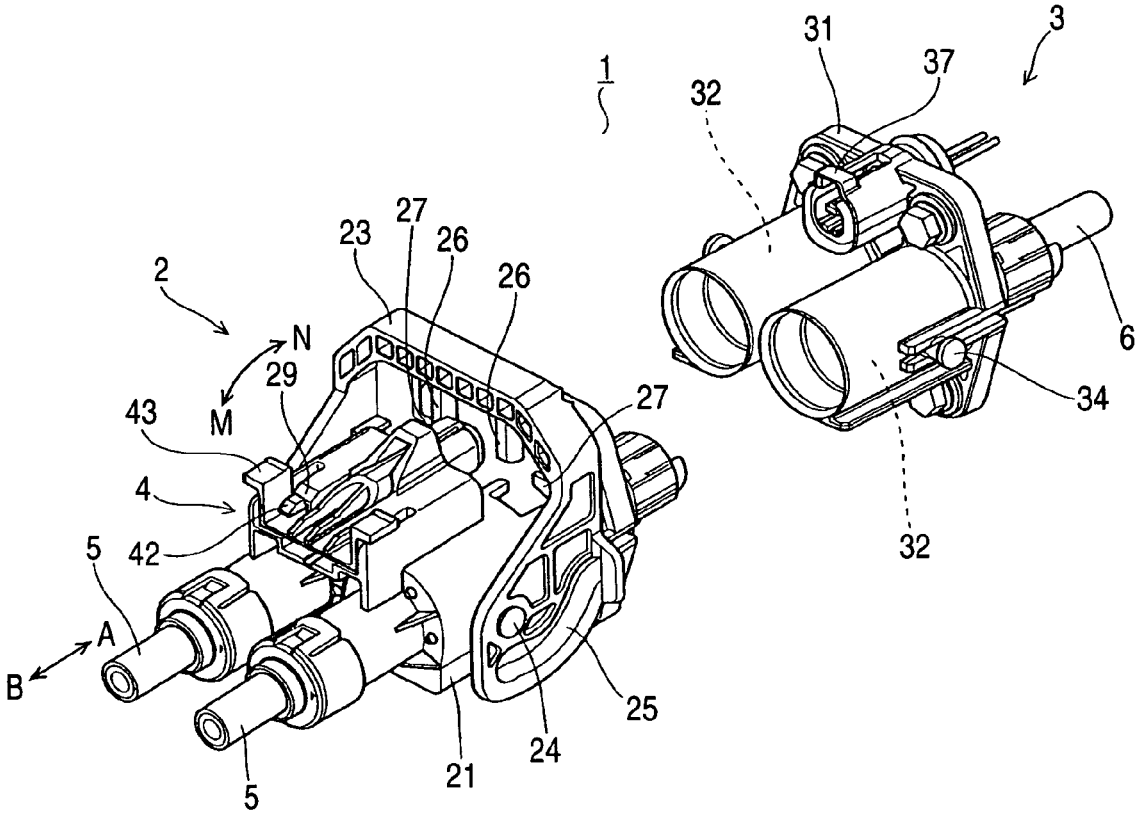
FIG. 1 is an exploded, perspective view of one preferred embodiment of a lever fitting-type connector of the present invention.
Figure 2:
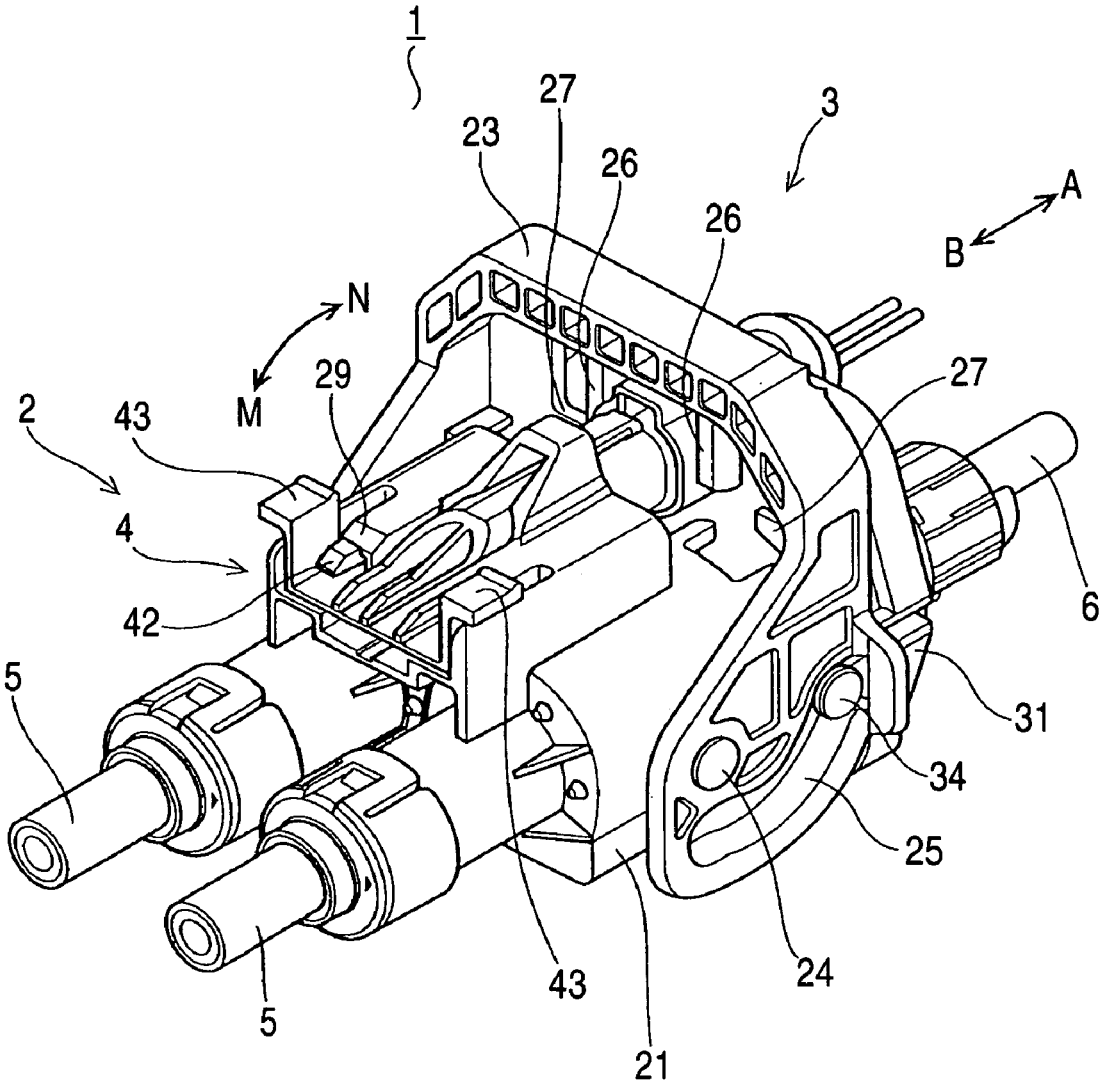
FIG. 2 is a perspective view of the lever fitting-type connector of FIG. 1, showing its provisionally-retained condition.
Figure 3:
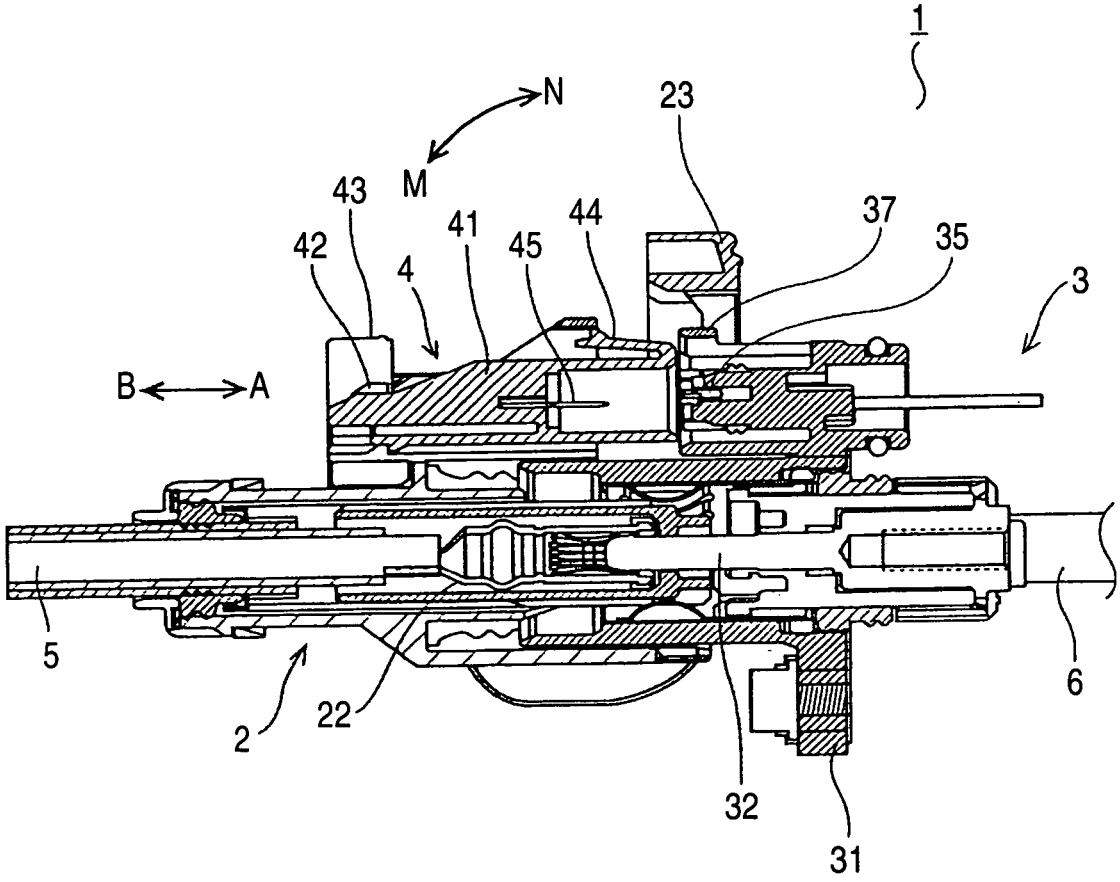
FIG. 3 is a cross-sectional view of the lever fitting-type connector of FIG. 1, showing its provisionally-retained condition.
Figure 4:
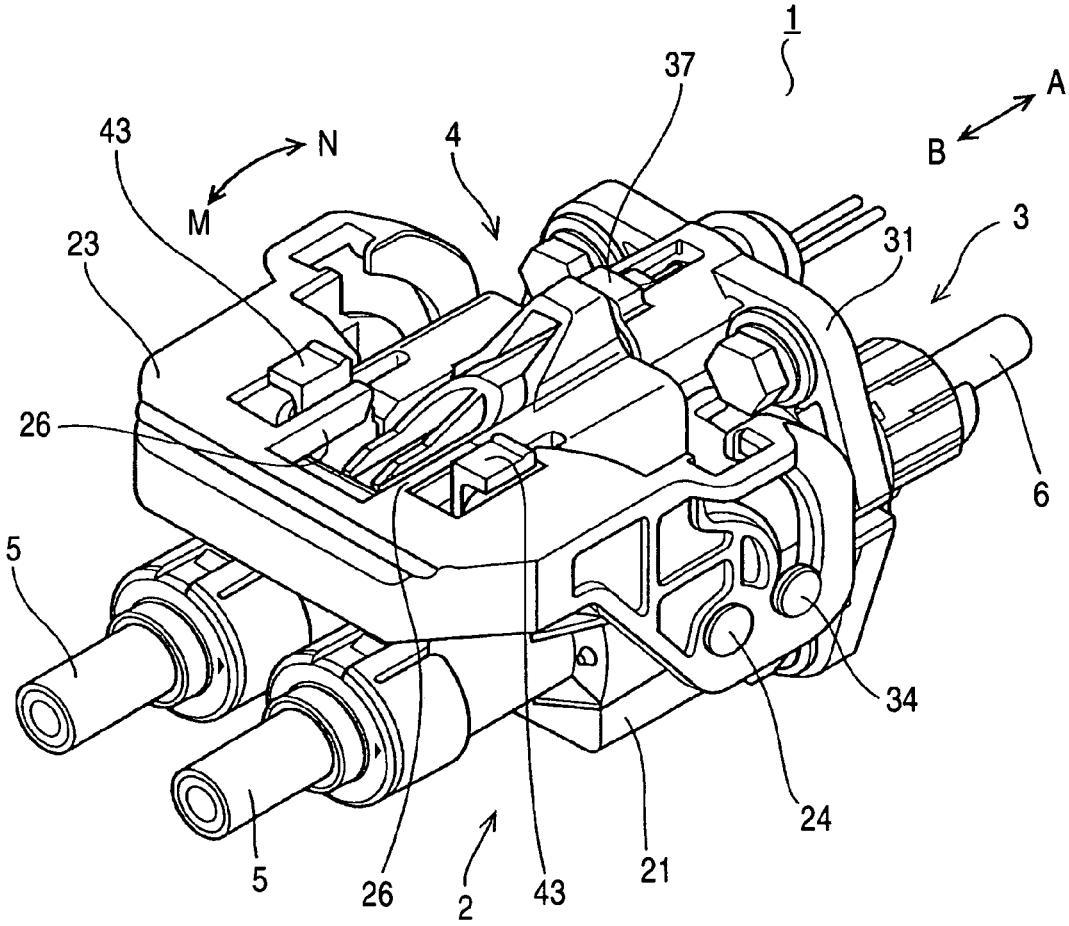
FIG. 4 is a perspective view of the lever fitting-type connector of FIG. 1, showing its completely-retained condition.
Figure 5:
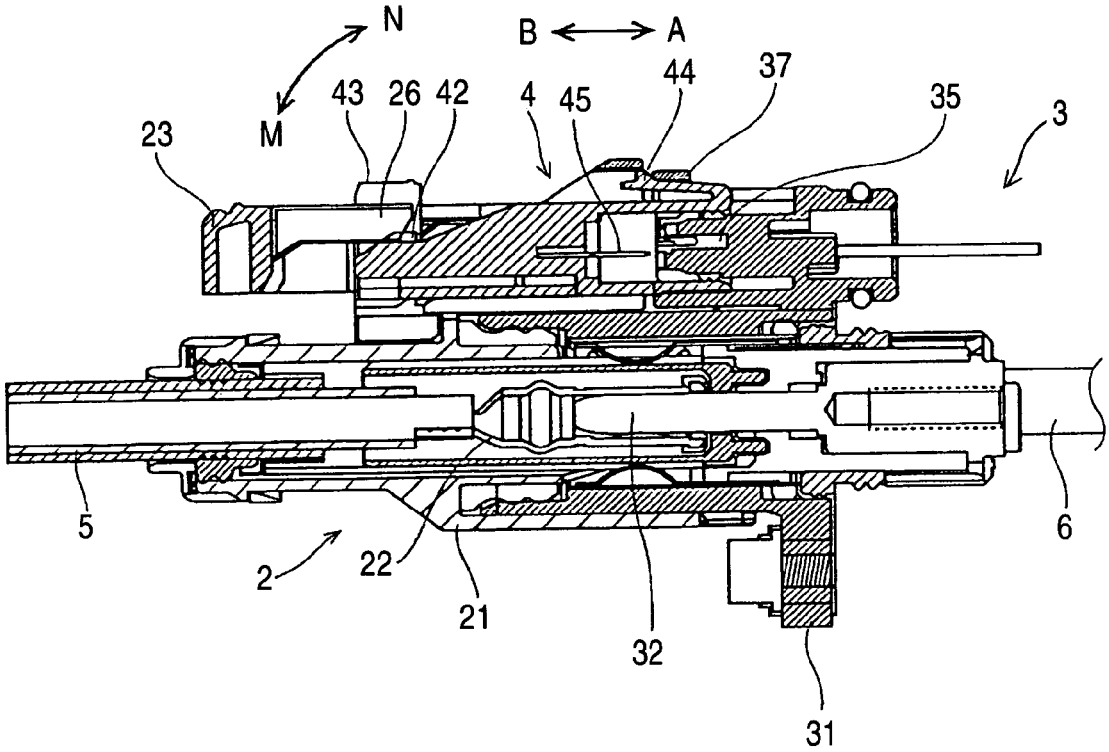
FIG. 5 is a cross-sectional view of the lever fitting-type connector of FIG. 1, showing its completely-retained condition.
Figure 6:
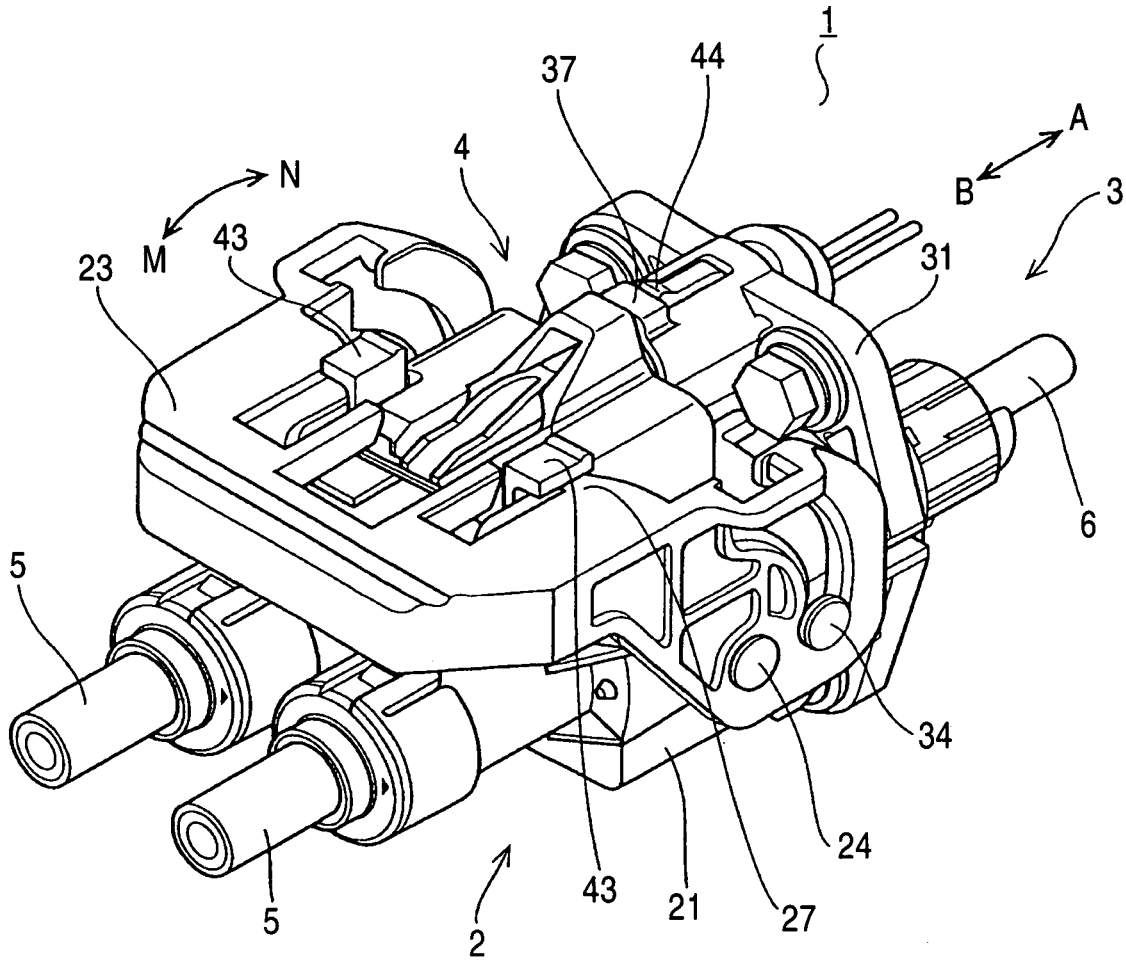
FIG. 6 a perspective view of the lever fitting-type connector of FIG. 1, showing its completely-fitted condition.
Figure 7:
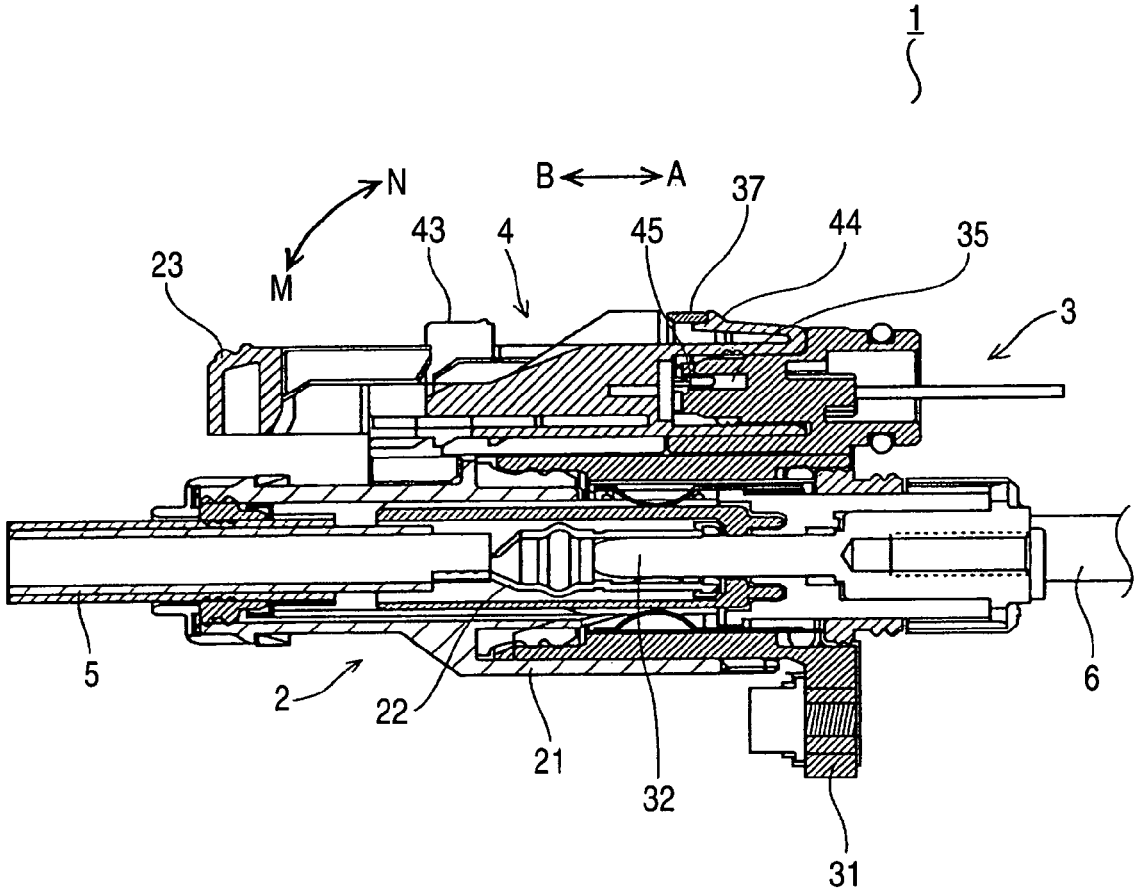
FIG. 7 is a cross-sectional view of the lever fitting-type connector of FIG. 1, showing its completely-fitted condition.

FIG. 1 is an exploded, perspective view of one preferred embodiment of a lever fitting-type connector of the invention, FIG. 2 is a perspective view of the lever fitting-type connector of FIG. 1, showing its provisionally-retained condition, FIG. 3 is a cross-sectional view of the lever fitting-type connector of FIG. 1, showing its provisionally-retained condition, FIG. 4 is a perspective view of the lever fitting-type connector of FIG. 1, showing its completely-retained condition, FIG. 5 is a cross-sectional view of the lever fitting-type connector of FIG. 1, showing its completely-retained condition, FIG. 6 a perspective view of the lever fitting-type connector of FIG. 1, showing its completely-fitted condition, FIG. 7 is a cross-sectional view of the lever fitting-type connector of FIG. 1, showing its completely-fitted condition.

As shown in FIG. 1, the lever fitting-type connector 1 comprises a female connector 2, a male connector 3, and a slider 4.

As shown in FIG. 2, the female connector 2 includes a housing 21 made of a synthetic resin. As shown in FIGS. 2 and 3, two female terminals 22 are contained in the housing 21, and wires 5 are connected to the female terminals 22, respectively. Slider retaining portions 29 are formed at an upper portion of the housing 21. A pair of pins 24 are formed on and project respectively from opposite (left and right) side surfaces of the housing 21, and a synthetic resin-made connecting lever 23 of a generally U-shape is mounted on these pins 24 so as to be pivotally moved about the pins 24 in a direction of arrow M and a direction of arrow N as shown in FIGS. 2 and 4. Guide grooves 25 are formed respectively in two leg portions of the connecting lever 23, and each guide groove 25 is formed into a generally arc-shape such that the distance of the guide groove 25 from the corresponding pin 24 gradually becomes shorter in a direction from its open distal end portion toward its inner closed end. A pair of lever projecting portions 26 and a pair of slider abutment portions 27 are formed on a grip portion of the connecting lever 23.

On the other hand, the male connector 3 includes a housing 31 made of a synthetic resin as shown in FIG. 1. Two male terminals 32 are contained in the housing 31, and wires 6 are connected to the male terminals 32, respectively. A slider retaining portion 37 is formed on an upper portion of the housing 31. Further, a pair of pins 34 are formed on and project respectively from opposite (left and right) side surfaces of the housing 31, and the pins 34 are opposed respectively to the open distal end portions of the guide grooves 25 of the connecting lever 23.

As shown in FIGS. 2 and 3, the synthetic resin-made slider 4 is mounted on the female connector 2 so as to move forward (in a direction of arrow A) and backward (in a direction of arrow B). The slider 4 includes a body 41, and a pair of lever holding walls 43 are formed on the body 41, and a pair of female connector retaining portions 42 and a male connector retaining portion 44 of a U-shape are formed on the body 41 so as to be elastically moved upward and downward.

As shown in FIG. 3, an interlocking male terminal 45 is contained in the body 41 of the slider 4, and an interlocking female terminal 35 is contained in the housing 31 of the male connector 3 in opposed relation to the interlocking male terminal 45. The interlocking male terminal 45 and the interlocking female terminal 35 are connected to a signal circuit for establishing and breaking electrical connection between the female connector (2)-side wires 5 and the male connector (3)-side wires 6. When the interlocking male terminal 45 and the interlocking female terminal 35 are connected together, this signal circuit is closed, and therefore the wires 5 are electrically connected to the respective wires 6. In contrast, when the interlocking male terminal 45 and the interlocking female terminal 35 are not connected together, this signal circuit is opened, and therefore the electrical connection between the wires 5 and the respective wires 6 is interrupted.

The lever fitting-type connector 1 has the above construction, and therefore the female connector 2 and the male connector 3 of this lever fitting-type connector 1 are fitted together according to the following procedure.

First, the female connector 2 and the male connector 3 are opposed to each other as shown in FIG. 1. At this time, the connecting lever 23 has been pivotally moved in the direction of arrow N, and therefore is disposed in an upstanding condition. Also, the slider 4 has been moved backward in the direction of arrow B, and therefore the female connector retaining portions 42 are engaged respectively with the slider retaining portions 29 of the female connector 2, thereby locking the slider 4 in its inoperative position. Furthermore, the interlocking male terminal 45 is not connected to the interlocking female terminal 35.

Then, the male connector 3 is inserted into the female connector 2 to be provisionally retained relative thereto as shown in FIGS. 2 and 3. As a result, the pins 34 of the male connector 3 are engaged respectively in the open distal end portions of the guide grooves 25 of the connecting lever 23. Also, the female terminals 22 of the female connector 2 are slightly fitted respectively to the male terminals 32 of the male connector 3. At this time, however, the interlocking male terminal 45 and the interlocking female terminal 35 are not yet connected together, and therefore there will not be encountered an undesirable situation in which the wires 5 are electrically connected to the respective wires 6 in this provisionally-retained condition (that is, in a half-fitted condition). Therefore, operations such as inspection and repair of an electric system can be carried out more safely.

Then, the female connector 2 and the male connector 3 are completely retained relative to each other as shown in FIGS. 4 and 5. To achieve this, the connecting lever 23 is pivotally moved through an angle of about 90 degrees in the direction of arrow M. As a result, the guide grooves 25, while kept engaged with the respectively pins 34, are rotated (or angularly moved) about the pins 24 in the direction of arrow M. At this time, the distance between each pin 24 and the corresponding pin 34, that is, the distance between the female connector 2 and the male connector 3, is decreasing in accordance with the pivotal movement of the connecting lever 23 in the direction of arrow M, since the distance of each guide groove 25 from the corresponding pin 24 gradually becomes shorter in the direction from its open distal end portion toward its inner closed end. As a result, the male connector 3 is drawn toward the female connector 2, and the female terminals 22 of the female connector 2 are positively fitted respectively to the male terminals 32 of the male connector 3. Thus, the female connector 2 and the male connector 3 are completely retained relative to each other.

Thus, the connector 1 is of the lever fitting-type in which by operating the connecting lever 23, the male connector 3 is drawn toward the female connector 2, and is completely retained relative thereto, and therefore an insertion force required for the male connector 3 in the provisionally-retained condition is small. However, the connecting lever 23 is not yet locked, that is, is kept in an unlocked condition.

When the connecting lever 23 is thus pivotally moved through an angle of about 90 degrees in the direction of arrow M, the lever projecting portions 26 depress the female connector retaining portions 42 of the slider 4, respectively, and therefore the locked condition of the slider 4 in its inoperative position is canceled, so that the slider 4 can advance in the direction of arrow A.

Finally, the connecting lever 23 is locked, thereby completely fitting the female connector 2 and the male connector 3 together a shown in FIGS. 6 and 7. To achieve this, the slider 4 is advanced in the direction of arrow A. As a result, the male connector retaining portion 44 is engaged with the slider retaining portion 37 of the male connector 3, so that the slider 4 is locked in its operative position, and therefore can not be moved backward in the direction of arrow B. Also, the lever holding walls 43 of the slider 4 are moved to be disposed respectively at the upper sides of the slider abutment portions 27, so that the connecting lever 23 can not be pivotally moved in the direction of arrow N. As a result, the connecting lever 23 is locked, and the female connector 2 and the male connector 3 are held in the completely-fitted condition.

Also, when the slider 4 is thus advanced in the direction of arrow A, the interlocking male terminal 45 is connected to the interlocking female terminal 35, so that the wires 5 are electrically connected respectively to the wires 6.

Here, the operation for fitting the female and male connectors 2 and 3 together is finished.

The thus fitted female and male connectors 2 and 3 can be disconnected from each other according to the following procedure.

First, the locked condition of the connecting lever 23 is canceled. To achieve this, the male connector retaining portion 44 of the slider 4 is depressed, thereby canceling the engagement thereof with the slider retaining portion 37 of the male connector 3, and then the slider 4 is moved backward in the direction of arrow B. As a result, the interlocking male terminal 45 is moved apart from the interlocking female terminal 35, so that the electrical connection between the wires 5 and the respective wires 6 is interrupted. Also, the lever holding walls 43 move backward respectively from the upper sides of the slider abutment portions 27 of the connecting lever 23, so that the connecting lever 23 can be pivotally moved in the direction of arrow N.

Then, the connecting lever 23 is pivotally moved through an angle of about 90 degrees in the direction of arrow N. As a result, each guide groove 25, while kept engaged with the corresponding pin 34, is rotated (or angularly moved) in the direction of arrow N, and therefore the distance between each pin 24 and the corresponding pin 34 is gradually increasing, and the male connector 3 is moved away from the female connector 2. As a result, the male terminals 32 are moved in such a direction as to be disconnected from the respective female terminals 22. However, at this time, the electrical connection between the wires 5 and the respective wires 6 has already been interrupted, and therefore there will not be encountered an undesirable situation in which the electrical connection between the wires 5 and the wires 6 is interrupted in the half-fitted condition. Therefore, the operations such as the inspection and repair of the electric system can be carried out more safely.

Finally, the male connector 3 is withdrawn from the female connector 2.

Here, the operation for disconnection the female and male connectors 2 and 3 from each other is finished.

In this lever fitting-type connector 1, the interlocking male terminal 45 is formed integrally with the slider 4, and the interlocking female terminal 35 is formed integrally with the male connector 3, and therefore the lever fitting-type connector 1 can be reduced in size or length, and besides the number of the component parts of the lever fitting-type connector 1 can be reduced.

In the above embodiment, although the locked condition of the slider 4 in its inoperative position is canceled in accordance with the pivotal movement of the connecting lever 23 in the direction of arrow M, the invention is not limited to such a construction, and there can be adopted an automatic lock mechanism in which in accordance with the pivotal movement of the connecting lever 23 in the direction of arrow M, the slider 4 is moved in the direction of arrow A to lock the connecting lever 23.

In the above embodiment, although the interlocking male terminal 45 is provided at the slider 4 while the interlocking female terminal 35 is provided at the male connector 3, the arrangement of the female and male terminals can be reversed, that is, the interlocking female terminal can be provided at the slider 4 while the interlocking male terminal can be provided at the male connector 3.

In the above embodiment, although the slider 4 is mounted on the female connector 2, the slider 4 can be mounted on the male connector 3 or the connecting lever 23.

This invention can be extensively applied to various fields of industries such as an automobile, an aircraft, an electric train, a production plant, an electric appliance and an OA equipment.

What is claimed is:

1. A lever fitting-type connector, comprising:

a fitting mechanism in which a pair of connectors are drawn toward each other to be retained relative to each other by operating a connecting lever, and in this condition a slider is slid to be engaged with said connecting lever to lock said connecting lever; and a signal circuit for electrically connecting wires connected to the respective connectors;

wherein said slider contains an interlocking electrical terminal for closing said signal circuit in a locked condition of said connecting lever and for opening said signal circuit in an unlocked condition of said connecting lever.

2. The lever fitting-type connector according to claim 1, wherein an operative-side lock mechanism for locking said slider disposed in an operative position, is provided.

3. The lever fitting-type connector according to claim 1, wherein an inoperative-side lock mechanism for locking said slider disposed in an inoperative position, is provided.

4. The lever fitting-type connector according to claim 3, wherein an inoperative-side lock cancellation mechanism for canceling a locked condition of said slider disposed in said inoperative position, is provided.

5. The lever fitting-type connector according to claim 1, wherein said interlocking electrical terminal is a first electrical terminal and wherein the lever fitting-type connector further comprises a second interlocking electrical terminal for mating with the first interlocking electrical terminal.

6. The lever fitting-type connector according to claim 5, wherein the slider is slidably disposed on one of the connectors and the second interlocking electrical terminal is disposed in the other of said connectors.

* * * * *